United States Patent [19]

Schwartz et al.

[11] Patent Number: 5,048,784

[45] Date of Patent: Sep. 17, 1991

[54] ADJUSTABLE INSET BRACKET

[75] Inventors: Edward M. Schwartz, Kansas City; Wilburn D. Everman, Belton, both of Mo.

[73] Assignee: Edtech Company, Kansas City, Mo.

[21] Appl. No.: 514,820

[22] Filed: Apr. 26, 1990

Related U.S. Application Data

[63] Continuation-in-part of Ser. No. 450,146, Dec. 13, 1989, Pat. No. 4,976,407.

[51] Int. Cl.[5] ..... A47G 29/02

[52] U.S. Cl. ..... 248/244; 248/118.3; 248/295.1; 400/715

[58] Field of Search ..... 248/118, 118.1, 118.3, 248/918, 919, 920, 442.2, 244, 245, 246, 295.1; 108/144, 148, 147; 400/715

[56] References Cited

U.S. PATENT DOCUMENTS

| | | | |
|---|---|---|---|
| 4,496,200 | 1/1985 | Hagstrom et al. | 248/918 X |
| 4,515,086 | 5/1985 | Kwiencinski et al. | 248/920 X |
| 4,621,781 | 11/1986 | Springer | 248/118 |
| 4,625,657 | 12/1986 | Little et al. | 108/148 X |
| 4,790,611 | 12/1988 | Craner | 108/147 X |
| 4,805,538 | 2/1989 | Fisher et al. | 108/147 X |
| 4,881,471 | 11/1989 | Schwartz et al. | 248/244 X |
| 4,976,407 | 12/1990 | Schwartz et al. | 248/118.3 |

OTHER PUBLICATIONS

Tiffany Office Futnirue Catalog, pp. 13-16 and 30, 2-1990.

Tiffany Office Furniture Catalog, pp. 3 and 11, 1989.

Tiffany and Co. brochure entitled, "Places for People", 1987.

*Primary Examiner*—Ramon O. Ramirez

*Attorney, Agent, or Firm*—Sughrue, Mion, Zinn Macpeak & Seas

[57] ABSTRACT

A work surface includes a recessed portion for receiving an adjustable inset which may support a keyboard for a video display terminal, a typewriter or simply serve as a writing surface. The inset is mounted to the work surface by means of adjustable inset brackets disposed at either longitudinal end thereof. The inset includes an adjustable wrist support mounted on the outer edge thereof. Each adjustable inset bracket comprises outer and inner plate-like members having aligned vertical elongated slots in vertical portions thereof for receiving a threaded shank portion of an adjustment handle. A fastening member is threadedly engaged with the threaded shank portion protruding from the aligned elongated slots. Upon loosening the adjustment handles for the right side adjustable inset bracket and for the left side adjustable inset bracket, the inset may be adjusted to positions above, level with and below the work surface and also tilted with respect to the work surface.

14 Claims, 8 Drawing Sheets

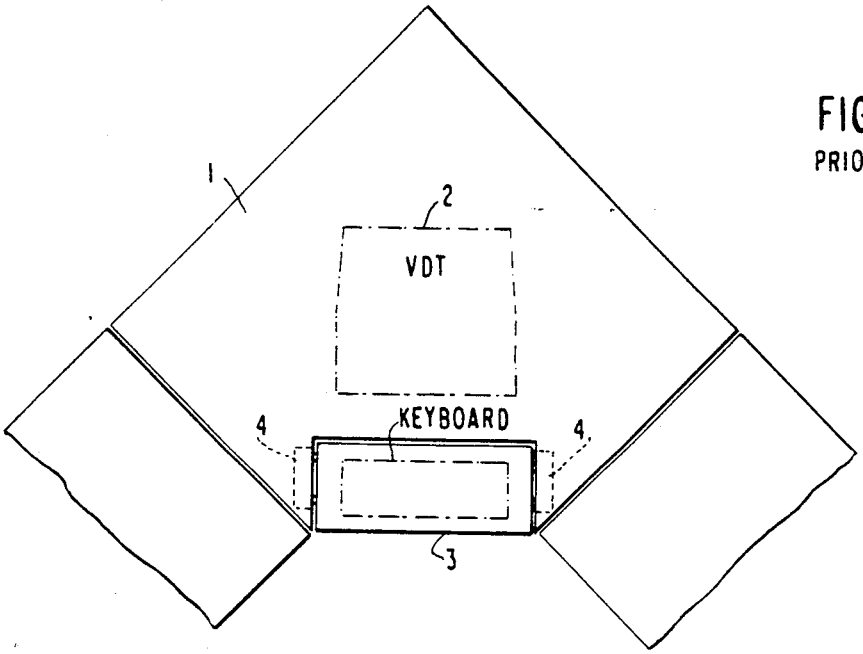
FIG. 1
PRIOR ART
FIG. 2
PRIOR ART
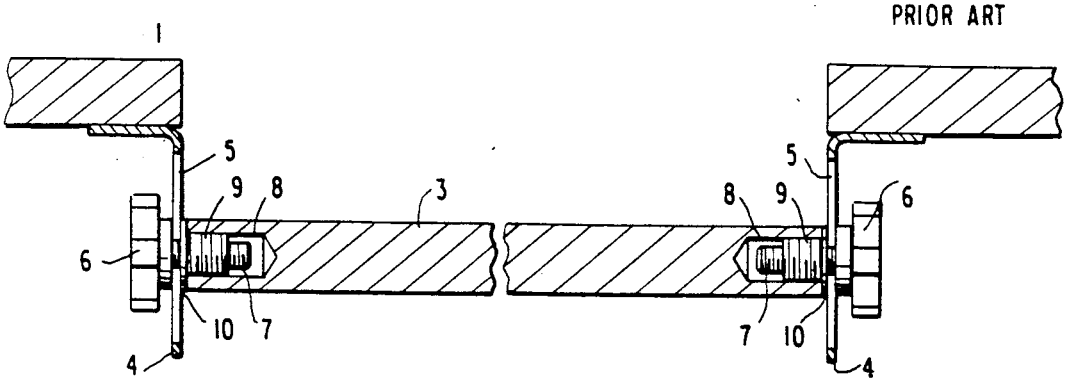
FIG. 3
PRIOR ART
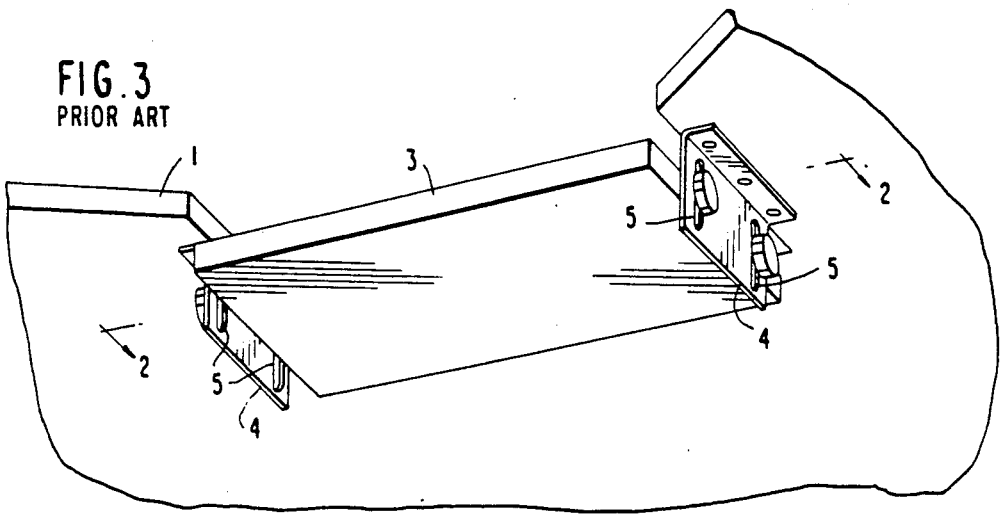

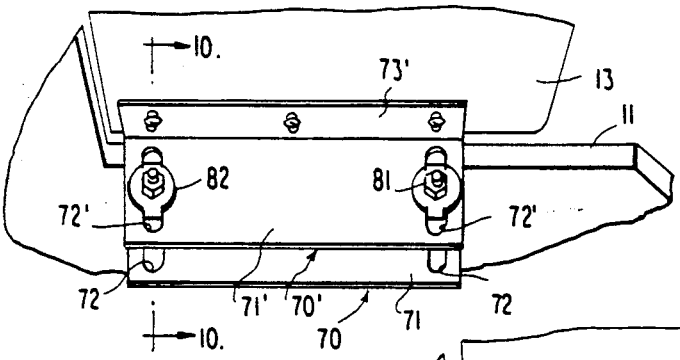
FIG. 9a
FIG. 9b
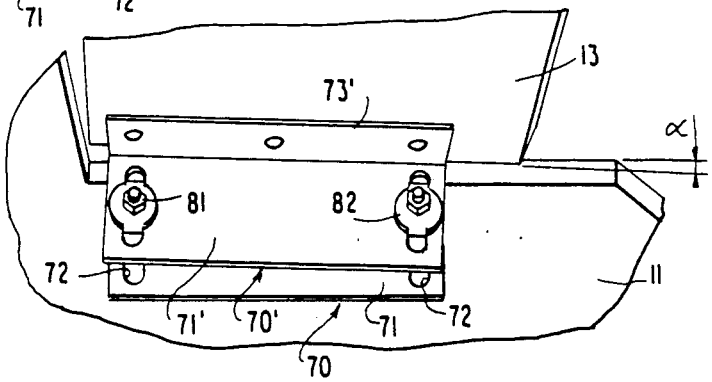
FIG. 10
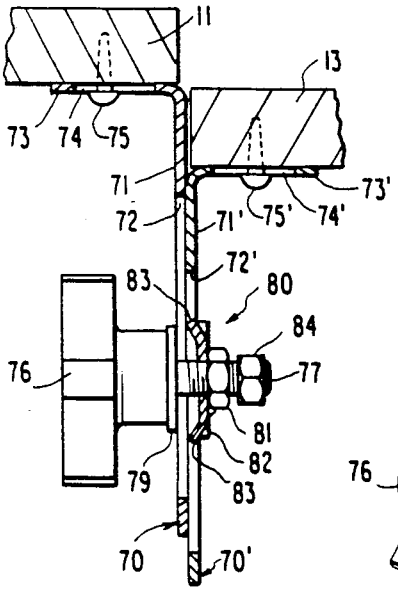
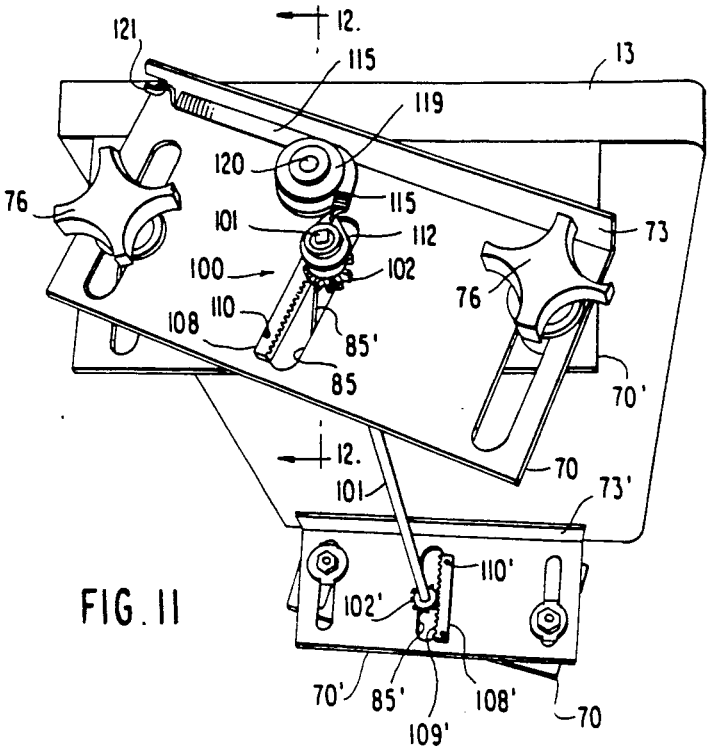
FIG. 11

FIG. 12
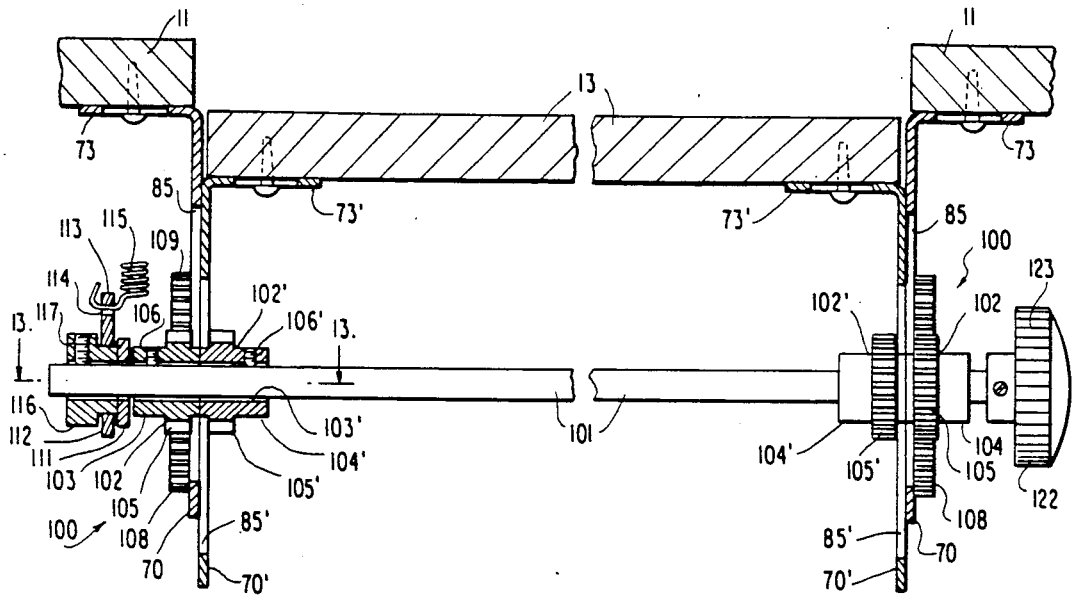
FIG. 13
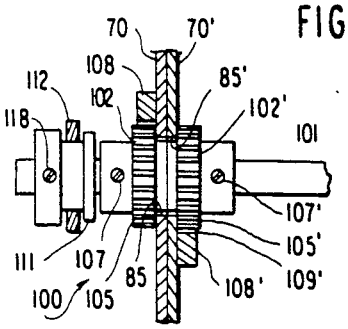
FIG. 14
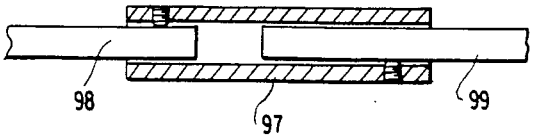
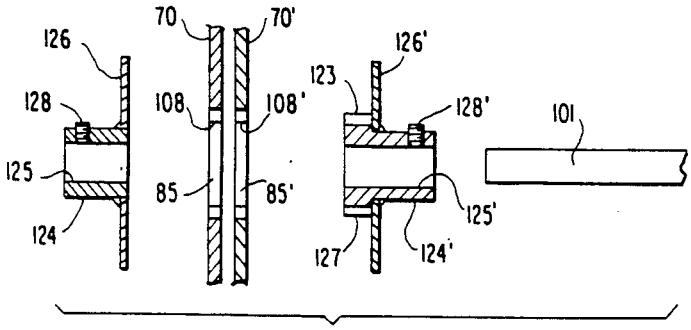
FIG. 15

FIG. 16
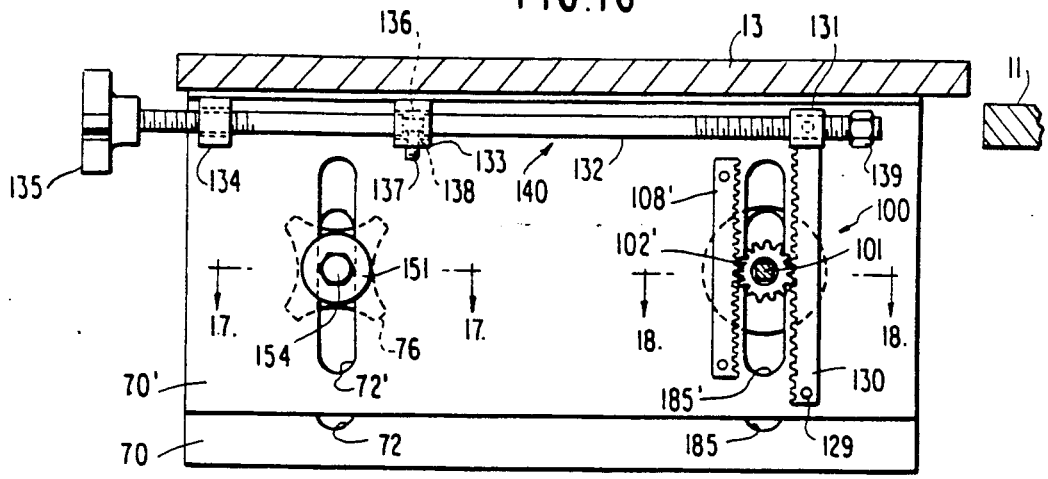
FIG. 17
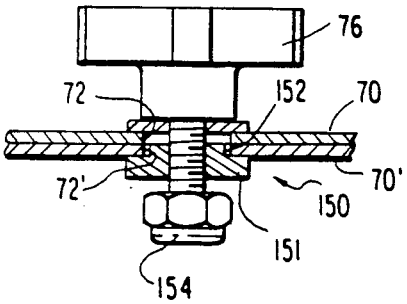
FIG. 18
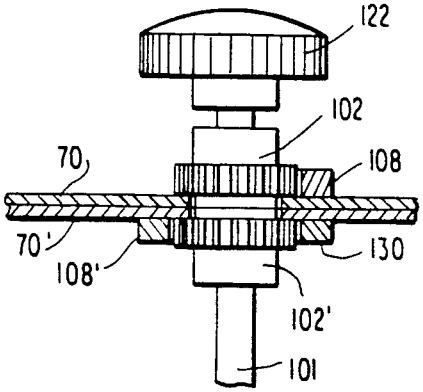
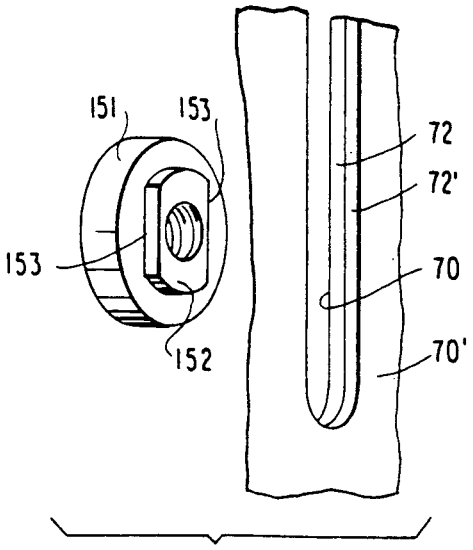
FIG. 19

FIG. 20
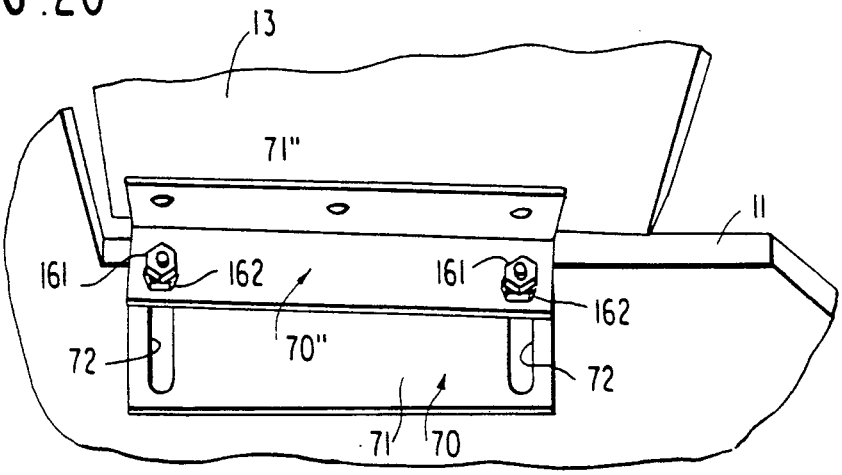
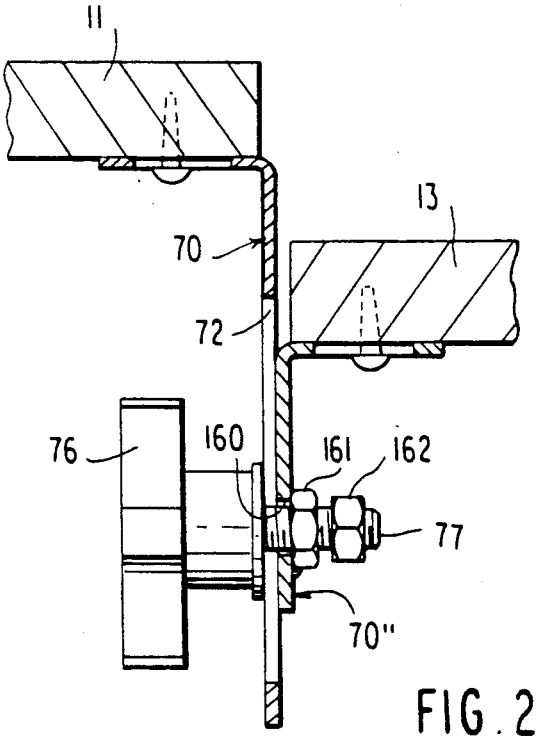
FIG. 21

ADJUSTABLE INSET BRACKET

CROSS REFERENCE TO RELATED APPLICATIONS

This is a continuation-in-part application of pending U.S. application Ser. No. 07/450,146 filed Dec. 13, 1989, now U.S. Pat. No. 4,976,407.

FIELD OF THE INVENTION

The invention relates to an adjustable inset bracket for adjusting the position of a keyboard inset or support which supports the keyboard used by typists and video display terminal operators. The invention further relates to a corner work surface including a cutout or recessed portion for receiving an adjustable keyboard inset. The inset is mounted to the work surface by means of adjustable inset brackets and includes an adjustable wrist support mounted on the outer edge thereof. The invention also has application as an adjustable inset bracket for adjusting an inset serving as a writing surface or for supporting a typewriter.

BACKGROUND OF THE INVENTION

There are at least 10 million video display terminals (hereinafter referred to as "VDTs") in use across the country, and it is predicted that there will be greater than 40 million VDTs by the end of this century. While VDTs are used for a variety of tasks, they are used most intensively by a range of office workers who may spend the entire day keypunching and processing information. It is estimated that keyboard intensive work involves about 18,000 keystrokes per hour by the typist or VDT operator. Each stroke requires the contraction of a muscle and movement of a tendon in the forearm. With high movement rates, there exists a possibility of damage to muscles and tendons as a result of the sliding action. The potential for muscle and tendon damage becomes greater when the arms and hands are used in awkward positions.

If the posture of a VDT operator s wrist is bent, thus bending the carpal tunnel, the tendons swell and the median nerve is compressed. This is referred to as Carpal Tunnel Syndrome and is one of the most common injuries. In addition, a whole variety of repetitive strain injuries, or RSI, are caused by improperly designed VDT work stations. In fact, it has been estimated by the American Academy of Orthopedic Surgeons in 1984 that RSI costs in lost earnings and medically related expenses will exceed $27 billion annually.

Accordingly, in order to prevent such injuries, it is necessary to ensure that the typist's or VDT operator's back, arms and hands be maintained in the proper position for typing. More specifically, the National Institute for Occupational Safety and Health (NIOSH) recommends that typists or VDT operators position the keyboard such that their elbows are bent at angles of 90°. In short, a properly designed work station should allow typists or VDT operators to keep their arms, from elbow to fingertips, in a straight line parallel to the floor so that they do not have to bend their wrists to type. Thus, it is necessary to provide work surfaces that can be adjusted for height, keyboard insets or supports which are adjustable, and adjustable wrist supports so as to permit a typist's or VDT operator's back, arms and wrists to be supported in the proper position.

Referring to FIG. 1, a prior art corner work surface top 1 is illustrated having a VDT 2 positioned thereon.

Further, a keyboard inset or support 3 which is movable up and down and also tilts is provided for supporting a keyboard. The keyboard inset is attached underneath the corner work surface top by means of adjustable brackets (see FIG. 2).

As shown in FIG. 2, the prior art keyboard inset is adjustably mounted to the work surface top 1 by means of a pair of L-shaped brackets 4. The brackets 4 are suitably attached to the underside of the work surface such that the vertical portion of each bracket is perpendicular to the work surface 1. As shown in FIG. 3, the vertical portion or longer leg of each L-shaped bracket includes a pair of elongated slots 5 disposed at either longitudinal end of the bracket. An adjustment handle 6 having a threaded shank 7 for threadedly engaging the keyboard inset is positioned in each elongated slot for up and down movement therein. Thus, each bracket has a pair of adjustment handles 6, i.e., a handle positioned in each elongated slot for a total of four handles.

The keyboard inset is a rectangular shaped surface formed of a suitable material such as wood, having a pair of spaced apart holes 8 at each longitudinal end thereof for receiving the threaded shank portion of the respective adjustment handle therein. A t-nut 9 is anchored in each of the above-mentioned holes 8 for threadedly engaging the threaded shank portion 7 of the respective adjustment handle 6. A washer 10 may be placed over the threaded shank portion of each adjustment handle before screwing the handle into the t-nut anchored in the hole of the keyboard inset so as to be positioned between the bracket and the inset. Accordingly, the keyboard inset may be adjusted up and down and tilted by loosening the four handles and manipulating the keyboard inset to the desired position and then again tightening the four handles to lock the inset in the desired position.

However, the problem associated with the prior art keyboard support as shown in FIGS. 1–3 is that the inset is not able to level with the work surface top. Further, the prior art keyboard inset must be thick and heavy in construction in order to support the t-nuts which receive the threaded shanks of the adjustment handles. Also, there is a problem in that the t-nuts tend to pull out of the keyboard inset after continued use.

SUMMARY OF THE INVENTION

It is an object of this invention to provide an adjustable keyboard inset bracket for an inset which overcomes the above-noted problems with respect to the prior art bracket. More specifically, it is an object of this invention to provide adjustable inset brackets which allow an inset to be adjusted such that the top of the inset can be made level, if required, with the top of the work surface.

It is a further object of this invention to provide adjustable inset brackets which allow the inset to be made thinner in thickness thereby improving its maneuverability and enhancing its aesthetic appearance.

It is a yet further object of this invention to provide adjustable inset brackets which allow the inset to tilt at every height of the inset and which allow the inset to be adjusted above or below the work surface as required by the typist or VDT operator.

It is a still further object of this invention to provide a corner work surface for a corner work station. In particular, the corner work surface includes a cutout or recessed portion for receiving a keyboard inset for supporting a keyboard. The keyboard inset is mounted to the corner work surface top by means of the adjustable inset brackets. The keyboard inset further includes an adjustable wrist support mounted on the outer edge thereof for supporting the wrists of the VDT operator while operating the keyboard. The keyboard inset is positioned within the cutout portion of the corner work surface top such that the adjustable wrist support is flush with the outer edge portion of the corner work surface top.

According to the first embodiment of the adjustable inset bracket, each adjustable inset bracket comprises a pair of plate-like members having an L-shaped cross section. A first or outer plate-like member has a vertically extending portion of an approximately triangular shape having a vertically extending elongated slot formed along a vertical center line thereof for receiving an adjustment handle therein. The outer plate-like member of the bracket also includes a horizontal flange portion, which is the shorter leg of the L, arranged along the top thereof and extending outwardly with respect to the inset. The flange portion is formed with a plurality of openings for receiving securing means for fastening the outer plate-like member to the underside of the work surface top. A second or inner plate-like member is shaped identical to the outer plate-like member. More specifically, the inner plate-like member includes a vertically extending portion which is approximately triangular in shape and includes a horizontal flange portion which faces inwardly with respect to the inset. The horizontal flange portion of the second plate-like member also includes a plurality of openings for receiving securing means for fastening the second or inner plate-like member to the underside of the inset. The vertical portion of the inner plate-like member also includes a vertically extending elongated slot formed along a vertical center line thereof for receiving a threaded shank of the adjustment handle.

After arranging washer means on the threaded shank portion of the adjustment handle, the threaded portion is inserted through the elongated slot of the vertical portion of the first or outer plate-like member such that the threaded portion protrudes through the opposite side of the outer plate-like member. Then, the elongated slot of the inner or second plate-like member is aligned such that the threaded shank portion of the handle can be inserted into fastening means so as to fasten together the inner and outer plate-like members of the bracket.

An adjustable inset bracket in the form of the inner and outer plate-like members is disposed at either longitudinal end of the inset, wherein the flange portions of each outer plate-like member are fastened to the underside of the work surface top and the flange portions of each inner plate-like member are fastened to the underside of the inset. Further, each bracket (i.e., left side and right side) includes an adjustment handle joining the inner and outer plate-like members as described above, thus giving a total of two adjustment handles.

Accordingly, upon tightening the handles, the two plate-like members are tightened together so as to lock the inset into a desired position. Upon loosening the handles, the handle and the threaded shank along with the inner bracket member are movable vertically up and down and also tiltable so as to adjust the position of the inset to a desired position.

According to the second embodiment of the adjustable inset bracket, each adjustable inset bracket comprises a pair of plate-like members having an L-shaped cross section similar to the first embodiment. However, the first or outer plate-like member has a vertically extending portion of a generally rectangular shape having vertically extending elongated slots formed at the longitudinal end portions of the plate-like member. The outer plate-like member of the bracket also includes a horizontal flange portion, which is the shorter leg of the L, arranged along the top thereof and extending outwardly with respect to the inset. The flange portion is again formed with a plurality of openings for receiving securing means for fastening the outer plate-like member to the underside of the work surface top. A second or inner plate-like member is shaped identical to the outer plate-like member. The horizontal flange portion of the inner plate-like member faces inwardly with respect to the inset and includes a plurality of openings for receiving securing means for fastening the second or inner plate-like member to the underside of the inset. The vertical portion of the inner plate-like member also includes a pair of vertically extending elongated slots.

With the two inner and outer plate-like members arranged face to face such that the elongated slots are aligned with one another, the elongated shank portion of the handle is inserted through the aligned slots and threadedly engaged with a fastening means positioned at the inner surface of the inner plate-like member so as to fasten together the two plate-like members.

Again, an adjustable inset bracket in the form of said inner and outer rectangular shaped plate-like members is disposed at either longitudinal end of the inset. Each bracket (i.e.. left side and right side) includes a pair of adjustment handles joining the inner and outer rectangular plate-like members, thus giving a total of four adjustment handles.

A third embodiment of the adjustable inset bracket is similar to the bracket system of the second embodiment, but further includes an elongated center slot formed in each plate-like member. A rack and pinion articulation means is positioned in the center slots of two abutting plate-like members for facilitating the raising and lowering of the inset by the VDT operator and for leveling the inner plate-like members of the right and left side brackets.

A fourth embodiment of the adjustable inset bracket is similar to the bracket system of the third embodiment in that it includes a rack and pinion articulation means for facilitating the raising and lowering of the inset by the VDT operator However, in this embodiment the rear right and left side handles are eliminated and the rack and pinion means is disposed toward the rear of the bracket system. Further, a locking rack and linkage means for engaging and disengaging the locking rack are added to ensure stability.

A fifth embodiment of the adjustable inset bracket is similar to the bracket system of the second embodiment except that only the outer plate-like member of the right and left side brackets has a pair of vertically extending elongated slots and the inner plate-like member of the right and left side brackets is smaller in size and simply has a pair of through-holes with threaded nuts welded to the inner plate-like members in alignment with the respective through-holes.

BRIEF DESCRIPTION OF THE DRAWINGS

Other features and advantages of the invention will be apparent from the following description taken in connection with the accompanying drawings, wherein:

Figure 1 is a top view of a prior art corner work surface;

FIG. 2 is a cross sectional view along the lines 2—2 in FIG. 3 and illustrating the prior art work surface top, the adjustable inset and brackets;

FIG. 3 is a perspective view from underneath the work surface top of the prior art brackets;

Figure 5(*b*) is a perspective view of the adjustable inset and adjustable wrist support mounted thereon according to the present invention;

Figure 5(*c*) is a sectional view of the adjustable wrist support taken along 5—5 in FIG. 5(*b*);

Figure 5(*d*) is a bottom view of the adjustable wrist support and a portion of the inset;

Figure 6(*b*) is a perspective view of the adjustable inset bracket extended downward such that the inset is positioned below the work surface;

FIG. 9(*a*), is a perspective view of the adjustable inset bracket according to a second embodiment and showing the adjustable bracket extended upwardly so as to position the inset above the work surface;

FIG. 9(*b*) is a perspective view of the adjustable inset bracket according to the second embodiment showing the adjustable bracket extended upwardly and tilted;

FIG. 10 is a cross sectional view of the adjustable inset bracket according to the second embodiment along the lines 10—10 in Figure 9(*a*) and showing the details of the fastening means for fastening the two plate-like members together;

FIG. 11 is a perspective view of the adjustable inset bracket according to a third embodiment;

FIG. 12 is a cross sectional view along the lines 12—12 in FIG. 11 and showing the details of the rack and pinion means according to the third embodiment;

FIG. 13 is a cross sectional view along the lines 13—13 in FIG. 12 and showing the pinion gears engaging the racks in the left side bracket according to the third embodiment;

Figure 14 is a sectional view of an alternative form of the square shaft;

FIG. 15 is an exploded view of an alternative form of the rack and pinion means;

FIG. 16 is a partial sectional view of the adjustable bracket according to a fourth embodiment and showing an inside view of the left side bracket;

FIG. 17 is a cross sectional view along the lines 17—17 in FIG. 16 and showing an alternative form of the washer member for the handle fastening means;

FIG. 18 is a cross sectional view along the lines 18—18 in FIG. 16 and showing the various racks;

FIG. 19 is an exploded view of the alternative form of the washer member;

FIG. 20 is a fragmentary perspective view of the adjustable bracket according to a fifth embodiment; and FIG. 21 is a cross sectional view through the bracket of FIG. 20.

DETAILED DESCRIPTION OF THE PREFERRED EMBODIMENTS

The invention will now be described with reference to the drawings.

Figure 4:
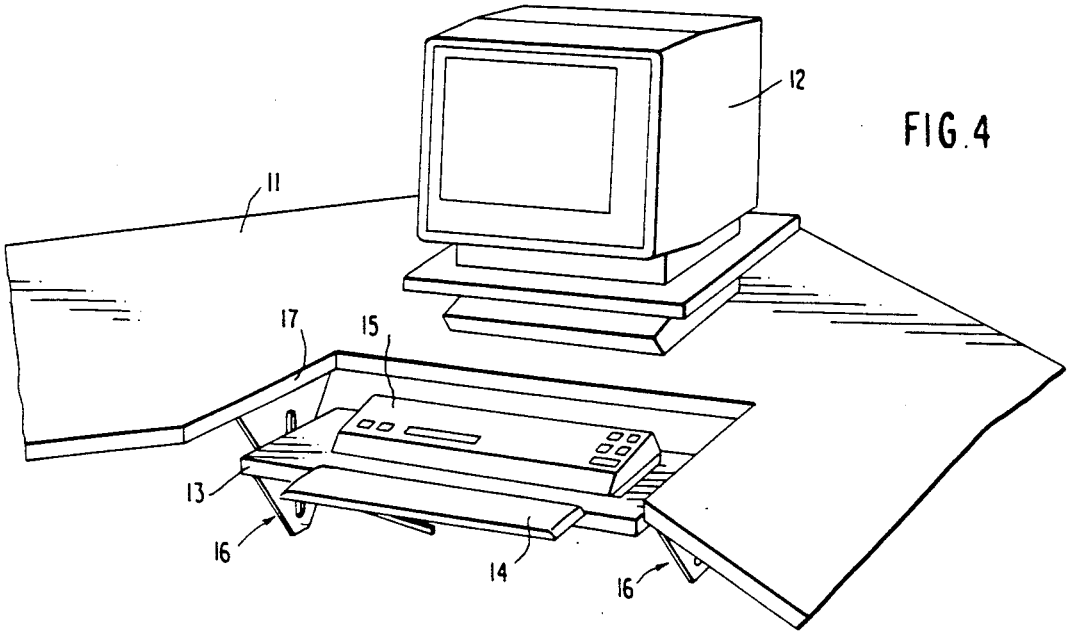
FIG. 4 is a perspective view of a corner work surface top of a corner work station according to the present invention.
Figure 5A:
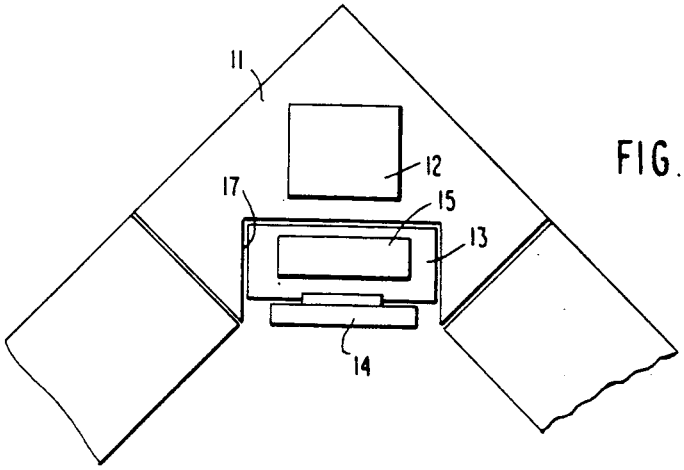
Figure 5(*a*) is a top view of the corner work surface top according to the present invention.
Figure 5C:
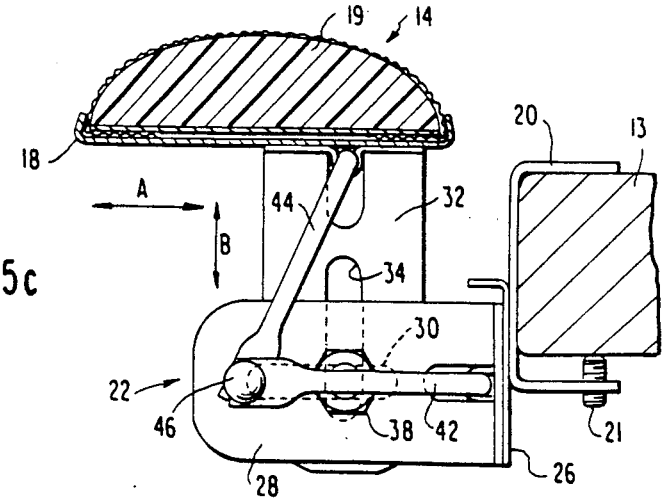
Figure 5B:
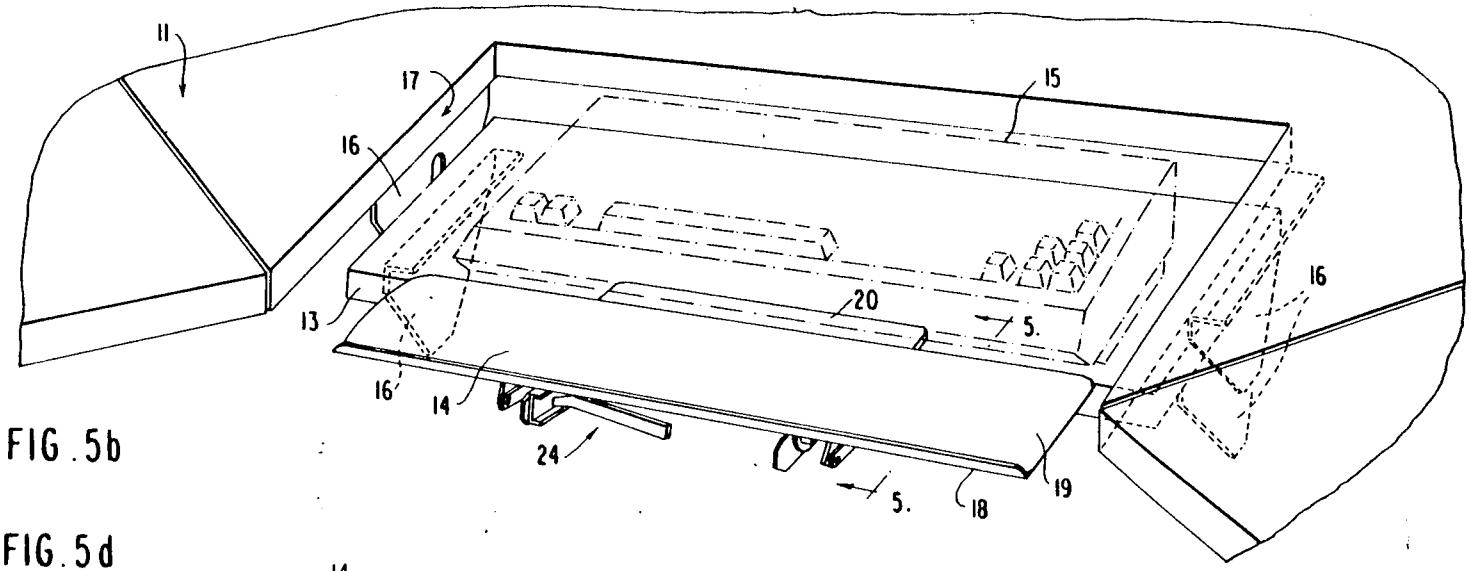
Figure 5D:
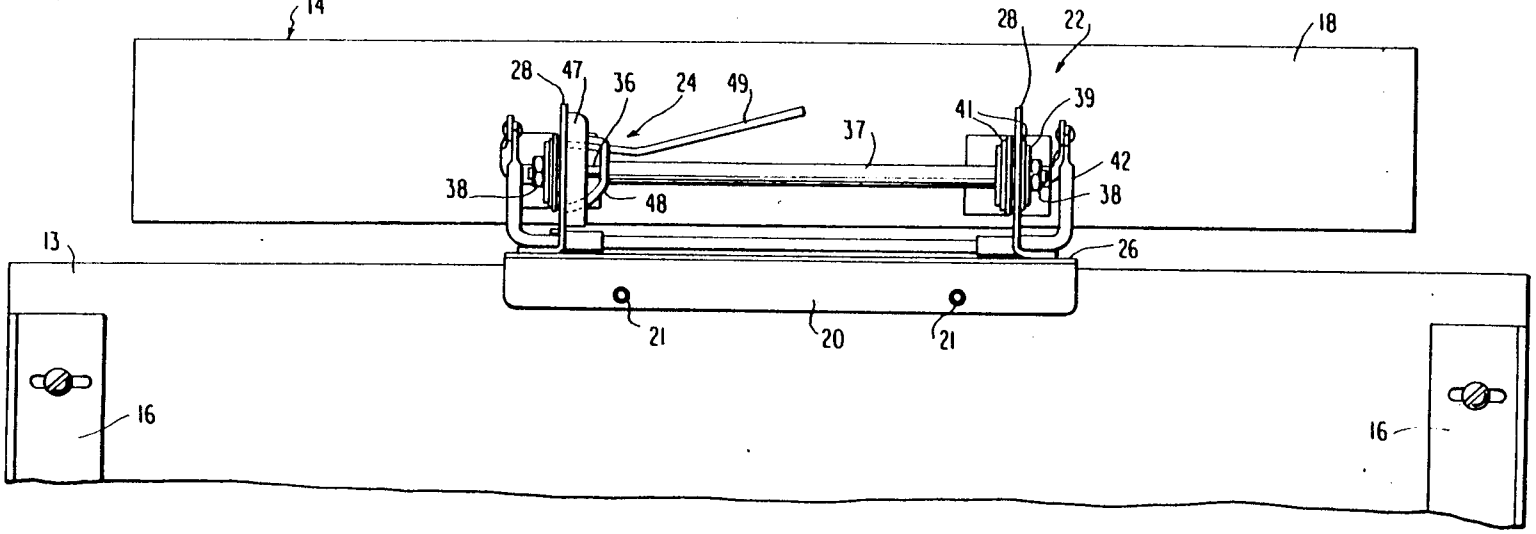

As shown in FIG. 4, the corner work surface 11 according to the present invention is vertically adjustable up and down by means of a vertical rack adjustment (not shown) the details of which are disclosed in U.S. Pat. No. 4,881,471 issued Nov. 21, 1989, and which is hereby incorporated by reference. A VDT 12 is suitably positioned on the corner work surface 11 for viewing by the VDT operator. An adjustable inset 13 having a keyboard 15 positioned thereon is adjustably attached to the work surface 11 by means of a pair of adjustable inset brackets 16, with a bracket being disposed at either longitudinal end of the inset 13. An adjustable wrist support 14 is fastened on the outer edge portion of the inset 13 so as to be positioned immediately in front of the keyboard in order to allow the VDT operator to rest his/her wrists thereon.

As best seen in FIGS. 5(*a*) and 5(*b*),. the inset 13 is arranged to fit within a cutout or recessed portion 17 formed in the work surface 11. The recessed portion is formed deep enough such that the wrist support 14 mounted on the outer edge of the inset 13 is flush with the edge portions of the work surface 11. The adjustable inset brackets 16 (one of which is visible in FIG. 5(*b*)) allow the keyboard inset to be adjusted above and below the work surface 11 and also level therewith. The brackets also allow the keyboard inset to be tilted at an angle with respect to the work surface 11. The specific details of the bracket will be described in detail below. With such a design, an inset and wrist support are obtained which are not only easily adjustable, but also aesthetically pleasing to the eye.

The wrist support device 14 is secured to the keyboard inset as shown in FIGS. 5(*b*)-5(*d*). The wrist support device 14 comprises a support bar 18 on which a pad 19 is disposed, a mounting bracket 20 for mounting the device on the inset 13 by means of set screws 21 (or screw-type turn knobs for hand fastening) threadedly engaged with the mounting bracket so as to engage the bottom of the inset 13 such that the wrist support is frictionally secured to the inset 13. An articulating mechanism 22 is provided for adjustably securing the support bar 18 to the mounting bracket 20. Also, a locking mechanism 24 is provided for locking the support bar in a desired position.

Referring to FIGS. 5(*c*) and 5(*d*), the articulating mechanism 22 for the wrist support 14 includes an L-shaped support bracket 26 which is fixedly secured to mounting bracket 20. A pair of connecting members 28 having slots 30 (shown by a broken line) disposed therein extend perpendicularly from the support bracket 26. Correspondingly, a pair of connecting members 32 having slots 34 disposed therein extend perpendicularly from the support bar 18. As shown in FIG. 5(*d*). a bolt 36, extending parallel to the mounting bracket 20 and support bar 18, is disposed in the slots 30. 34 for respectively connecting the first connecting members 28 to the second connecting members 32. An annular spacer 37 circumscribes the bolt. A nut 38, washer 39 and friction members 41 are disposed on opposite ends of the bolt 36 to rotatably fasten the bolt to the connecting members 28. 32.

Accordingly, the support bar 19 is adjustably secured to the support bracket 26 via the connecting members 28, 32. Since each of the connecting members 23, 32 have slots 30, 34 disposed therein for receiving bolt 36, the support bar 16 is independently adjustable as shown by the arrows A, B in FIG. 5(*c*). Note, links 42 and 44 may be provided for additional stability. A pair of first links 42 are pivotably secured at one end thereon to the support bracket 26 and a pair of second links 44 are pivotably supported at one end thereof to the support bar 18. The other ends of the first and second links 42, 44 are pivotably secured to one another by a pin 46.

Finally, a locking mechanism 24 is provided for securing the support bar in a desired position. The locking mechanism includes a friction pad 47, lever bracket 48 and lever 49. In operation, once the support bar 18 is adjusted, the operator pushes lever 49 such that an end portion of the lever 49 urges the friction pad 47 against the connecting member 28 such that the connecting member is engaged with the connecting member 32 to thereby lock the support bar 18 in place. The annular spacer 37 simply prevents the lever bracket 48 from moving inwardly along the bolt 36 when the lever 49 is pushed to lock the support member 18 in place. Accordingly, the support bar 18 of the adjustable wrist support 14 can be adjusted to substantially any desired position to accommodate the operators of different sizes and having different keypunching styles.

A first embodiment of the adjustable inset brackets for supporting keyboard inset 13 will now be described with reference to Figures 6(*a*), 6(*b*), FIG. 7, FIGS. 8(*a*) and 8(*b*).

Figure 6A:
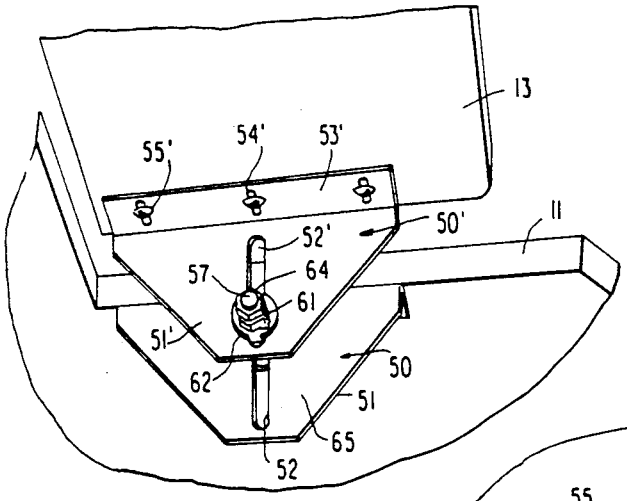
FIG. 6(*a*) is a perspective view showing an adjustable inset bracket according to a first embodiment of the present invention such that the inset is positioned above the work surface.
Figure 6B:
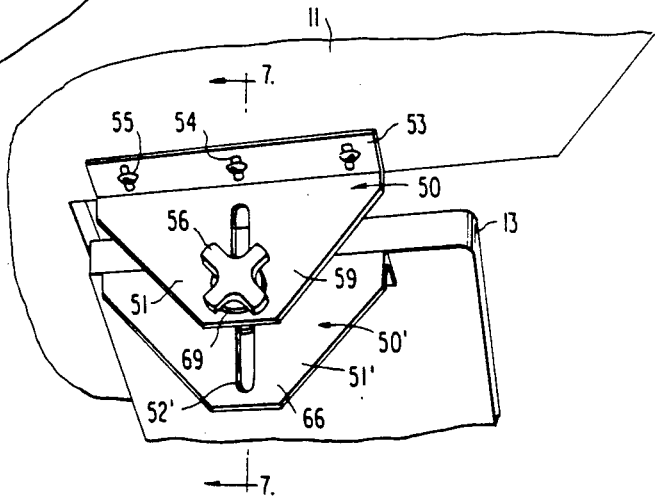

As shown in FIG. 6(*a*), each adjustable inset bracket includes a pair of plate-like members 50, 50' having an L-shaped cross section and being approximately triangular in shape. A first or outer plate-like member 50 includes a vertically extending portion 51 having an elongated slot 52 formed along a vertical center line thereof for receiving the threaded shank portion 57 of an adjustment handle 56. Along the top surface of the vertically extending portion 51, a horizontal flange portion 53 (which is the shorter leg of the L) extends outwardly and has a plurality of through-holes 54 for receiving securing means 55. Accordingly, the outer plate-like member 50 is suitably fastened to the underside of the work surface 11 by means of securing means 55 such as, lag screws, wood screws, etc.

A second or inner plate-like member 50', which is identical in shape and size to the outer plate-like member 50, is disposed such that a horizontal flange portion 53' having a plurality of through-holes 54' therein faces inwardly toward the inset 13. A plurality of securing means 55' such as lag screws, etc., are inserted into the through-holes 54' of the flange portion 53' in order to secure the inner plate-like member 50' to the inset 13. The vertically extending elongated slot 52' of the inner member 50' is then aligned with the vertically extending slot 52 of the outer plate-like member 50. The adjustment handle 56 has a star-like configuration to facilitate gripping by the operator's hand. The threaded shank portion 57 is inserted through the aligned elongated slots 52, 52' and threadedly engaged with a fastening means 60 situated against the inner face 58 of the inner plate-like member 50'. Suitable washer means 69 may be placed over the threaded shank 57 of the handle 56 before the handle is inserted into the elongated slots 52, 52' so as to be positioned between the handle and the outer face 59 of the outer plate-like member 50.

Figure 7:
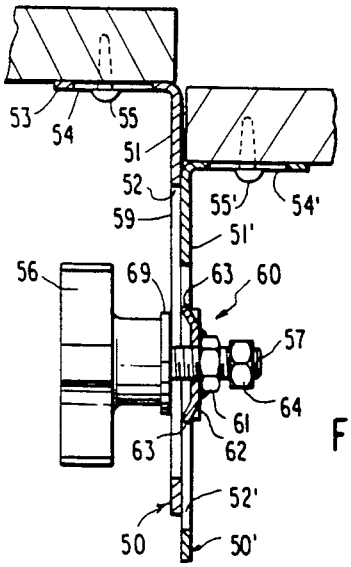
FIG. 7 is a cross sectional view of the first embodiment of the present invention along the lines 7—7 in FIG. 6(*b*) and showing the details of the fastening means and retaining nut for fastening together the plate-like members which form the adjustable inset bracket.

As best shown in FIG. 7, the fastening means 60 may take the form of a nut 61 spot welded to a washer 62, the washer 62 having two opposing tabs or tongues 63 formed opposite from one another along the circumference of the washer 62 which are bent inwardly so as to fit into the elongated slot 52' of the inner plate-like member 50'. The tabs or tongues 63 thereby prevent the nut 61 from turning when the adjustment handle 56 is turned. Thus, two identical plate-like members may be employed for the inner and outer plate-like members 50, 50' and thereby reduce the cost of manufacture with respect to the brackets. Further, a restraining nut 64 may be placed over the protruding end of the threaded shank portion 57 of the handle 56 in order to prevent the tabs or tongues 63 of the washer-like member 62 from slipping out of the elongated slot 52' and to also prevent the handle 56 from coming out. A separate adjustable inset bracket 16 as described above is disposed at either longitudinal end of the inset 13. Hence, a total of two adjustment handles must be manipulated in order to adjust the height of the inset according to the first embodiment of the inventive adjustable inset bracket.

In operation, upon loosening the handles of the right-hand side and left-hand side brackets 16, the inner plate-like member 50' along with the adjustment handle 56 of each bracket are allowed to move up and down and rotate with respect to the elongated slot 52 of each outer plate-like member 50. FIGS. 6(*a*) and 6(*b*) illustrate the inset 13 positioned above the work surface 11 and below the work surface 11, respectively. Of course, the inset 13 can also be positioned level or tilted with respect to the work surface 11.

Figure 8A:
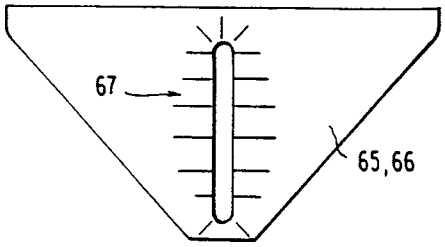
FIGS. 8(*a*) and 8(*b*) illustrate various methods of roughening the inside surfaces of the plate-like members.
Figure 8B:
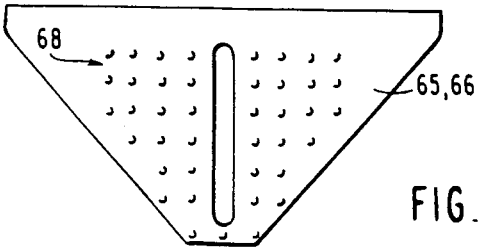

As shown in FIGS. 8(*a*) and 8(*b*), it is advantageous to provide friction means on the abutting surfaces 65 and 66 of the inner plate-like member 50 and the outer plate-like member 50' in order to prevent the two plate-like members from slipping with respect to each other during adjustment of the inset 13. In particular, a sunburst pattern 67, as shown in FIG. 8(*a*), may be stamped into the abutting surfaces 65 and 66 of the plate-like members to provide a roughened surface to prevent slipping between the plate-like members during adjustment. Further, as shown in FIG. 8(*b*), a checked pattern 68 may be stamped into the abutting faces 65 and 66 of the two plate-like members to provide a roughened surface.

In a second embodiment of the adjustable inset bracket, as shown in FIGS. 9(*a*), 9(*b*) and 10, each adjustable inset bracket comprises a pair of plate-like members 70, 70' having an L-shaped cross section similar to the first embodiment. However, the first or outer plate-like member 70 has a vertically extending portion 71 of a generally rectangular shape having a pair of vertically extending elongated slots 72, with a slot being formed at the longitudinal end portions of the outer plate-like member. The outer plate-like member 70 of the bracket also includes a horizontal flange portion 73, which is the shorter leg of the L. arranged along the top thereof and extending outwardly with respect to the keyboard inset 13. The flange portion 73 is formed with a plurality of through-holes 74 for receiving securing means 75, such as lag screws, for fastening the outer plate-like member 70 to the underside of the work surface top 11.

A second or inner plate-like member 70' is shaped identical to the outer plate-like member 70. The horizontal flange portion 73' of the inner plate-like member 70' faces inwardly with respect to inset 13 and likewise includes a plurality of through-holes 74' for receiving securing means 75', such lag screws, for fastening the inner plate-like member 70' to the underside of the inset 13. The vertical portion 71' of the inner plate-like member 70' also includes a pair of vertically extending elongated slots 72'.

With the left side bracket including an inner plate-like member 70' attached to the inset 13 and an outer plate-like member 70 attached to the underside of the work surface 11, and the right side bracket including inner and outer plate-like members 70', 70 fastened to the keyboard inset and the work surface, respectively, the two elongated slots 72 of each of the right side outer plate-like member and left side outer plate-like member are aligned with the two elongated slots 72' of the right side inner plate-like member and the left side inner plate-like member, respectively. Respective adjustment handles 76 are insert through the aligned slots 72, 72' such that the threaded shank portion 77 of each handle 76 protrudes through the aligned slots 72, 72' and threadedly engages with a corresponding fastening means 80 positioned at the inner surface 78 of the inner plate-like member 70' so as to fasten together the two plate-like members of each bracket. Thus, each bracket comprises two adjustment handles 76 disposed in the aligned elongated slots 72, 72' giving a total of four adjustment handles 76 for adjusting the position of the keyboard inset 13. Again, a suitable washer means 79 may be placed over the threaded shank 77 of each handle 76 before the handles are inserted into the respective slots 72, 72'.

Each fastening means 80 for retaining the respective handle 76 in the aligned slots 72, 72' may take the form of a nut 81 welded to a washer 82 similar to the fastening means 60 described above with respect to the first embodiment. Again, the washer member 82 includes a pair of tongues or tabs 83 formed at an outer circumferential portion of the washer 82 and bent inwardly toward the elongated slot 72' of the inner plate-like member 70' so as to be guided therein during up and down movement of the handle when the bracket is being adjusted by the operator. Likewise, a restraining nut 84 may be threadedly engaged over the threaded shank portion 77 of the adjustment handle which protrudes through the nut 81 welded to the washer 82. As described above with respect to the first embodiment, the restraining nut 84 simply ensures that the tongue portions 83 of the washer 82 remain in the elongated slot 72' and also prevents the handle from coming off (see FIG. 10).

With the above described bracket, upon loosening of the four adjustment handles 76, the inset 13 can be positioned upwardly so as to be above the work surface as shown in FIG. 9(*a*) or adjusted downwardly so as to be positioned below the work surface 11 as shown in FIG. 9(*b*). Of course, the inset 13 can be positioned level with the work surface if desired or tilted by an angle $\alpha$ to suit the needs of the particular VDT operator. Once the desired position is determined by the operator, the adjustment handles are simply tightened to fix the left side bracket and the right side bracket in the desired position and thereby fix the keyboard at the proper height for the operator.

It is noted that while the adjustment handles 76 of the first and second embodiments are shown positioned on the outside of the plate-like members of the inset bracket, the handles on one or both sides could likewise be positioned on the inside of the plate-like member.

A third embodiment of the adjustable inset bracket, as shown in FIGS. 11–15, is similar to the bracket system of the second embodiment but further includes an elongated center slot formed in each plate-like member 70,70' (note, like elements are denoted by like reference numerals). Further, a rack and pinion articulation means is positioned in the center slots of two abutting plate-like members for facilitating the raising and lowering of the inset by the VDT operator as described in detail below.

As shown in FIG. 11, the left and right side brackets according to the third embodiment are illustrated. The outer and inner plate-like members 70 and 70' respectively, are identical to the plate-like members of the second embodiment except that each plate-like member includes an elongated slot or opening 85,85' centrally located between the slots 72,72', respectively. The center slots 85 and 85' of the outer and inner plate-like members are provided for receiving a rack and pinion articulation means generally denoted by the numeral 100.

The rack and pinion articulation means includes a rod or shaft 101 having a square cross-section. The shaft 101 passes through the aligned center slots 85 and 85' of the right side bracket plate members 70,70' and the left side bracket plate members 70,70'.

As shown in FIGS. 12 and 13, an inner pinion gear 102' having a through-hole 103' is fitted over the left end of the shaft. The inner pinion gear 102' includes a cylindrical portion 104' having one end which projects into and is slidably disposed in the center slot 85' of the inner plate-like member 70'. The pinion gear 102' further includes a plurality of teeth 105' arranged around the outer circumference of the cylindrical portion 104'. The outer diameter of the pinion gear is greater than the width of the center slot 85' such that the side faces of the teeth abut against the inner plate-like member 70'. The other end of the cylindrical portion 104' includes a hole 106', which is perpendicular to the through-hole 103'. The hole 106' receives a set screw 107'for rigidly securing the inner pinion gear 102' to the shaft 101.

The teeth 105' of the inner pinion gear 102' are engaged with a rack 108' disposed at a side portion (e.g., the left side as viewed from the inside of the left side bracket) of the center slot 85'. As shown in FIGS. 11 and 13, the rack 108' is provided with a plurality of teeth 109' and is pinned to the inner plate-like member 70' with pins 110'. Alternatively, the rack could be stamped directly in the inner plate-like member 70' along the side edge of the center slot 85' as discussed in detail later on.

As shown in FIGS. 11–13, the shaft 101 protrudes through the center slot 85 of the outer plate-like member 70. A second, outer pinion gear 102, identical to the inner pinion gear 102', is fitted over the shaft 101 by means of the through-hole 103. A cylindrical portion 104 has one end which projects into the center slot 85 of the outer plate-like member 70 and is slidable therein. The side faces of the teeth 105 abut against the outer plate-like member 70. The other end of the cylindrical portion 104 includes a hole 106, which is perpendicular to the through-hole 103. The hole 106 receives a set screw 107 for rigidly securing the outer pinion gear 102 to the shaft 101. The two pinion gears 102,102' thereby assist in holding the plate-like members 70,70' together by virtue of the abutting side surfaces of the teeth 105,105'.

The outer pinion gear 102 is engaged with a rack 108 disposed at a side portion (e.g. the left side as viewed from the outside of the left side bracket) of the center slot 85 (see FIG. 11). The rack 108 is provided with a plurality of teeth 109 and is pinned to the outer plate-like member 70 with pins 110. Again, the rack may be stamped directly in the outer plate-like member 70 along the side edge of the center slot 85 as described in detail later on. Thus, the racks 108 and 108' are disposed opposite to one another with respect to the aligned center slots 85 and 85' of the outer and inner plate-like members 70 and 70', respectively.

As best shown in FIGS. 11–13, after the second or outer pinion gear 102 is positioned in place on the shaft 101, a washer member 111 may be inserted over the shaft followed by a second, larger washer-like member 112 having an enlarged portion 113 with an opening 114 therein for attaching the end of a tension spring 115 (described in detail below). Finally, a ring member 116 having a hole 117 in the side thereof for receiving a set screw 118 is provided for retaining the washer member 111 and washer-like member 112 on the shaft 101.

The left end of the square shaft 101 can be extended beyond the ring member 116 to allow for minor adjustments in the length of the shaft 101 by simply cutting off any excess length thereof. Alternatively, as shown in FIG. 14, the shaft 101 may be formed by two separate pieces 98 and 99 which are joined together with a tubular adjustment sleeve 97. Thus, the ends of the pieces 98 and 99 are simply slid into the sleeve 97 and positioned so as to give a desired shaft length. Set screws (unnumbered) passing through the side of the sleeve 97 at either end portion are then tightened to fix the desired shaft length in place.

The above-mentioned tension spring 115 is provided to further facilitate the lifting of the inset 13 by applying an upward force on the shaft 101. More specifically, a plastic roller 119 positioned above and to the left of the shaft 101 (see FIG. 11) is rotatably mounted on a support member 120 which in turn is mounted to the outer plate-like member 70 of the left side bracket by suitable means such as a rivet (not shown). Further, a projection 121 is attached by suitable means, such as welding, to the underside and at the rear of the horizontal flange portion 73 of the outer plate-like member 70. The projection 121 is slightly hook shaped.

Accordingly, one end of the tension spring 115 is attached to the opening 114 of the washer-like member 112. The spring 115 then passes above and around the roller 119 and the opposite end of the spring is hooked over the projection 121.

Thus far, a rack and pinion articulation means and related parts has been described with respect to the left side bracket. As concerns the right side bracket, the configuration of the rack and pinion means 100 is identical to that of the left side bracket (note, like elements are denoted by like reference numerals) except that the portion of the square shaft 101 which extends beyond the outer pinion 102 is fitted with a handle 122 (see FIG. 12). It is also noted that, as shown in FIG. 12, the rack 108 is positioned along the right-hand side of the center slot 85 of the outer plate-like member 70 as viewed from outside the right side bracket. Likewise, the rack 108' is positioned along the right-hand side of the center slot 85' of the inner plate-like member 70' as viewed from inside the right side bracket (see FIG. 11).

The handle 122 is suitably fixed on the end of the shaft 101 and includes a roughened circumference 123 for facilitating gripping by the VDT operator.

In operation, the VDT operator simply loosens the four handles 76 and then turns the handle 122 of the rack and pinion articulation means 100 which in turn rotates the shaft 101 and the pinions 102,102' of the right and left side brackets to thereby raise or lower the inset 13 depending on the direction of rotation of the handle 122. As noted above, the tension spring 115 facilitates the raising of the inset 13. Once the inset 13 is adjusted to the desired height, the VDT operator then tightens the four handles 76 to lock the inset in place, although only the front right and left side handles 76 need to be tightened.

The rack and pinion articulation means of the third embodiment facilitates lifting of the inset 13 and also levels the right and left side brackets with respect to one another.

While the handle 122 is shown disposed on the right side, a second handle may be fixed on the left side of the shaft 101 for a left-handed operator.

Further, while the handles 76 for the right and left side brackets are shown on the outside, the handles may be positioned on the inside.

As described above, the racks 108,108' could alternatively be formed directly in the plate-like members 70,70' along a side surface of the center slots 85,85', respectively. In such a configuration, the pinion 123 may be a two-piece member, as shown in FIG. 15. One piece includes a cylindrical portion 124 having a through-hole 125 for sliding over the square shaft and a fender washer 126 welded on a side portion thereof. The other piece includes a cylindrical portion 124', through-hole 125' and fender washer 126' and further includes a gear portion 127 which extends through both center slots 85,85' to engage with the respective racks 108,108' formed directly in the outer and inner plate-like members 70,70', respectively. Again, each piece would include a set screw 128,128' to fix the pinion pieces to the square shaft 101.

A fourth embodiment of the adjustable inset bracket, as shown in FIGS. 16–19, is similar to the bracket system of the third embodiment in that it includes a rack and pinion articulation means for facilitating the raising and lowering of the inset 13 by the VDT operator. However, in this embodiment the rear right and left side handles 76 are eliminated and the rack and pinion means 100 is disposed toward the rear of the bracket system so as to allow the inset to be lowered without the shaft 101 of the rack and pinion means interfering with the knees of the VDT operator. Further, a locking rack 130 is added in order to ensure stability. Again, like elements are denoted by like reference numerals.

The rack and pinion articulation means 100 according to the fourth embodiment is identical in construction to that of the third embodiment except for the fact that it is positioned to the rear of the bracket system and also includes a locking rack 130 described in detail below. Thus, a discussion of the identical parts will be dispensed with for the sake of brevity.

FIG. 16 shows an inside view of the left side inner plate-like member 70'. The rack and pinion means 100 is disposed in slots 185, 185 of the outer and inner plate-like members 70, 70'. In addition to the rack 108', which is fixed along the left side (when viewed from the inside of the left side bracket) of the slot 185', a locking rack 130 is pivotably mounted along the right side of the slot 185' or opposite to the fixed rack 108 (see FIG. 18).

The locking rack 130 is pivotably mounted to the inner plate-like member 70' at a lower end thereof on a pivot pin 129. The upper end of the locking rack 130 is movably pinned to a threaded nut 131. The threaded nut 131 forms part of a linkage means 140 for engaging and disengaging the locking rack 130. The threaded nut 131 is threadedly engaged with a threaded shaft 132 such that upon back-and-forth movement of the nut 131, the upper end of the locking rack 130 is swung toward and away from the inner pinion gear 102' to engage with or disengage from the same.

The threaded shaft 132 is slidably supported in spaced apart support nuts 133 and 134 which are riveted to the underside of the horizontal flange portion 73' of the inner plate-like member 70'. Both of the support nuts 133 and 134 have the internal threads removed therefrom.

The threaded shaft 132 has a groove 136 machined therein. A set screw 137 is screwed into a threaded hole 138 in the underside of the support nut 133 and extends into the groove 136. The threaded shaft 132 is turned by means of a handle 135 which protrudes beyond the left side bracket in the front thereof for manipulation by the VDT operator.

Therefore, upon turning the handle 135 counterclockwise, the threaded shaft 132 rotates within support nuts 133 and 134 and the threaded nut 131 moves toward the rear of the inset 13 so as to pivot the locking rack 130 to an unlocked position. Likewise, upon turning the handle 135 in a clockwise direction, the nut 131 moves toward the front of the inset to engage the locking rack 130 with the pinion 102'.

A stop nut 139 may be threadedly disposed on the end of threaded shaft 132 behind the nut 131 in order to prevent the VDT operator from pivoting the locking rack 130 too far in the unlocked position.

In the fourth embodiment, the two handles 76 positioned at the front of the right and left brackets are identical to those of the third embodiment. However, as shown in FIGS. 17 and 19, the fastening means 150 for retaining the respective handle 76 in the aligned slots 72, 72' of the outer and inner plate-like members 70, 70' takes the form of a threaded washer-like member 151 threadedly engaged with the handle shank and having a projection 152 with flat sides 153. The projection 152 is slidably fitted within the elongated slot 72' of the inner plate-like member 70' so as to be guided therein during up and down movement of the handle 76. A nut 154 is provided for retaining the washer member 151 on the end of the threaded shank portion 77 of the respective handle 76.

In operation of the fourth embodiment, the VDT operator turns the handle 135 counterclock-wise, for example, in order to unlock the locking rack 130 and then loosens the two handles 76. By turning the handle 135 counterclockwise, the nut 131 is moved toward the rear of the inset 13 (as shown in FIG. 16) so as to pivot the locking rack 130 away from the pinion 102' to thereby unlock the rack and pinion means 100. Once unlocked, the operator can turn the handle 122 of the rack and pinion means 100 which in turn rotates the shaft 101 and the pinions 102, 102' of the right and left side brackets to thereby raise or lower the rear of the inset 13 depending on the direction of rotation of the handle 122. Then, any tilting of the inset 13 may be carried out by swinging the front of the inset 13 to thereby set the inset at the desired angle. Then, the handle 135 is turned clockwise to in turn pivot the locking rack 130 into engagement with the pinion 102' so as to lock the rack and pinion means 100 in the desired position. Also, the two handles 76 in the front right and left side brackets are tightened.

Although the locking rack 130 and associated linkage 140 are disposed on the left side inner plate-like member 70', they could likewise be positioned on the right side inner plate-like member. Further, while the locking rack 130 is disposed on the right side or in back (see FIG. 16) of the slot 185', it could likewise be positioned on the left side or in front of the slot 185'.

Also, the spacing between the elongated slots 72, 72' and 185, 185' of the outer and inner plate-like members may be varied for optimum performance. A center elongated slot may also be included in the outer and inner plate-like member 70, 70' for permanent tightening of the brackets by a suitable fastening means.

A fifth embodiment of the adjustable inset bracket, as shown in FIGS. 20 and 21, is similar to the bracket system of the second embodiment in that it includes inner and outer rectangular plate-like members for the right and left side brackets. However, only the outer plate-like member 70 has the pair of vertically elongated slots 72 therein. Again, like elements are denoted by like reference numerals.

As shown in FIGS. 20 and 21, the inner plate-like member 70'' has a pair of spaced-apart through-holes 160. Corresponding threaded nuts 161 are welded to the inner plate-like member 70'' in alignment with their respective through-holes 160 for receiving the threaded shank portion 77 of a respective adjustment handle 76. A lock nut 162 is threadedly engaged with the end of the shank 77.

The width of the vertically extending. rectangular portion 71'' of the inner plate-like member is smaller than that of the vertically extending portion 71 of the outer plate-like member.

In operation, the fifth embodiment is the same as the second embodiment except that the inset 13 cannot be positioned above the work surface due to the configuration of the inner plate-like members 70''. Of course, the inset can be positioned level with or below the work surface and is also tiltable With respect to the work surface by means of the bracket system of the fifth embodiment.

Although two elongated slots 72 and nuts 161, etc. are shown with respect to the fifth embodiment, it is also contemplated that a one slot/one nut configuration or a three slot configuration could be employed.

It is contemplated that numerous modifications may be made to the corner work surface and adjustable inset brackets of the present invention without departing from the spirit and scope of the invention as defined in the following claims.

What is claimed is:

1. Adjustable inset brackets for an inset, said inset being disposed in a recessed portion of a work surface, a corresponding one of said adjustable inset brackets being disposed at either longitudinal end of said inset, each of said adjustable inset brackets comprising:

(a) a first outer plate-like member having a generally L-shaped cross-section including a first vertically extending portion and a first horizontal flange portion facing outwardly, said first vertically extending portion having at least one vertical elongated slot formed therein, said first horizontal flange portion having a plurality of first spaced-apart through-holes formed therein, and said first horizontal flange portion of said first outer plate-like member being fixedly secured to an underside of said work surface by securing means passing through said plurality of first spaced-apart through-holes;

(b) a second inner plate-like member disposed face-to-face so as to contact said first outer plate-like member and having a generally L-shaped cross-section including a second vertically extending portion and a second horizontal flange portion facing inwardly, said second vertically extending portion having at least one vertical elongated slot which is aligned with the elongated slot of the first outer plate-like member, said second horizontal flange portion having a plurality of second spaced-apart through-holes formed therein, and said second horizontal flange portion of said second inner plate-like member being fixedly secured to an underside of said inset by securing means passing through said plurality of second spaced-apart through-holes;

(c) an adjustment handle having a threaded shank portion, said threaded shank portion passing through the aligned vertical elongated slots of said first outer and second inner plate-like members, respectively; and (d) fastening means threadedly engaged with said threaded shank portion of said adjustment handle to thereby secure said first outer and second inner plate-like members together, wherein said fastening means comprises a nut spot welded to a washer, said washer having a pair of opposing tongues formed along an outer circumference thereof, each of said tongues bent inwardly so as to fit into the elongated slot of said inner plate-like member; whereby upon loosening of said adjustment handle of each of said adjustable inset brackets, said inset is adjustable to positions above, level with and below said work surface and tiltable with respect thereto.

2. The adjustable inset brackets according to claim 1, wherein said first vertically extending portion of said first outer plate-like member and said second vertically extending portion of said second inner plate-like member are approximately triangular in shape, each of said first and second vertically extending portions including a single vertical elongated slot formed along a vertical center line thereof for receiving said threaded shank portion of said adjustment handle, such that each adjustable inset bracket has a corresponding said adjustment handle.

3. The adjustable inset brackets according to claim 2, wherein said first outer plate-like member and said second inner plate-like member are substantially identical in size and shape.

4. The adjustable inset brackets according to claim 1, wherein said first vertically extending portion of said first outer plate-like member and said second vertically extending portion of said second inner plate-like member are generally rectangular in shape, each of said first and second vertically extending portions including a pair of spaced apart vertical elongated slots for receiving said threaded shank portion of a corresponding said adjustment handle, such that each adjustable inset bracket has two adjustment handles.

5. The adjustable inset brackets according to claim 4, wherein said first outer plate-like member and said second inner plate-like member are substantially identical in size and shape.

6. Adjustable inset brackets for an inset, said inset being disposed in a recessed portion of a work surface, a corresponding one of said adjustable inset brackets being disposed at either longitudinal end of said inset, each of said adjustable inset brackets comprising:

(a) a first outer plate-like member having a generally L-shaped cross-section including a first vertically extending portion and a first horizontal flange portion facing outwardly, said first vertically extending portion having at least one vertical elongated slot formed therein, said first horizontal flange portion having a plurality of first spaced-apart through-holes formed therein, and said first horizontal flange portion of said first outer plate-like member being fixedly secured to an underside of said work surface by securing means passing through said plurality of first spaced-apart through-holes;

(b) a second inner plate-like member disposed face-to-face so as to contact said first outer plate-like member and having a generally L-shaped cross-section including a second vertically extending portion and a second horizontal flange portion facing inwardly, said second vertically extending portion having at least one vertical elongated slot which is aligned with the elongated slot of the first outer plate-like member, said second horizontal flange portion having a plurality of second spaced-apart through-holes formed therein, and said second horizontal flange portion of said second inner plate-like member being fixedly secured to an underside of said inset by securing means passing through said plurality of second spaced-apart through-holes;

(c) an adjustment handle having a threaded shank portion, said threaded shank portion passing through the aligned vertical elongated slots of said first outer and second inner plate-like members, respectively; and (d) fastening means threadedly engaged with said threaded shank portion of said adjustment handle to thereby secure said first outer and second inner plate-like members together; whereby upon loosening of said adjustment handle of each of said adjustable inset brackets, said inset is adjustable to positions above, level with and below said work surface and tiltable with respect thereto;

wherein said vertically extending portion of said first outer plate-like member and said second vertically extending portion of said second inner plate-like member are generally rectangular in shape, each of said first and second vertically extending portions including a pair of spaced apart vertical elongated slots for receiving said threaded shank portion of a corresponding said adjustment handle, such that each adjustable inset bracket has two adjustment handles; and further wherein each said first outer plate-like member and said second inner plate-like member further include an additional elongated center slot disposed between said pair of spaced apart vertical elongated slots; and further comprising a rack and pinion articulation means disposed in said center elongated slots.

7. Adjustable inset brackets for an inset, said inset being disposed in a recessed portion of a work surface, a corresponding one of said adjustable inset brackets being disposed at either longitudinal end of said inset, each of said adjustable inset brackets comprising:

outer and inner plate-like members secured to an underside of said work surface and said inset, respectively, so that said outer and inner plate-like members are in face-to-face contact with each other, each of said outer and inner plate-like members having at least one elongated slot near an end portion thereof and an elongated center slot;

an adjustment handle having a shank portion passing through said elongated slots, said shank portion receiving fastening means thereon; and a rack and pinion means disposed in said elongated center slots for raising and lowering said inset.

8. Adjustable inset brackets for an inset, said inset being disposed in a recessed portion of a work surface, a corresponding one of said adjustable inset brackets being disposed at either longitudinal end of said inset, each of said adjustable inset brackets comprising:

(a) a first outer plate-like member having a generally L-shaped cross-section including a first vertically extending portion and a first horizontal flange portion facing outwardly, said first vertically extending portion having at least one vertical elongated slot formed therein, said first horizontal flange portion having a plurality of first spaced-apart through-holes formed therein, and said first horizontal flange portion of said first outer plate-like member being fixedly secured to an underside of said work surface by securing means passing through said plurality of first spaced-apart through-holes;

(b) a second inner plate-like member disposed face-to-face so as to contact said first outer plate-like member and having a generally L-shaped cross-section including a second vertically extending portion and a second horizontal flange portion facing inwardly, said second vertically extending portion having at least one vertical elongated slot which is aligned with the elongated slot of the first outer plate-like member, said second horizontal flange portion having a plurality of second spaced-apart through-holes formed therein, and said second horizontal flange portion of said second inner plate-like member being fixedly secured to an underside of said inset by securing means passing through said plurality of second spaced-apart through-holes;

(c) an adjustment handle having a threaded shank portion, said threaded shank portion passing through the aligned vertical elongated slots of said first outer and second inner plate-like members, respectively; and (d) fastening means threadedly engaged with said threaded shank portion of said adjustment handle to thereby secure said first outer and second inner plate-like members together; whereby upon loosening of said adjustment handle of each of said adjustable inset brackets, said inset is adjustable to positions above, level with and below said work surface and tiltable with respect thereto, wherein said first vertically extending portion of said first outer plate-like member and said second vertically extending portion of said second inner plate-like member are approximately triangular in shape, each of said first and second vertically extending portions including a single vertical elongated slot formed along a vertical center line thereof for receiving said threaded shank portion of said adjustment handle, such that each adjustable inset bracket has a corresponding said adjustment handle, and further wherein an inner face of said first vertically extending portion of said first outer plate-like member and an outer face of said second vertically extending portion of said second inner plate-like member include friction means thereon in order to prevent said outer and inner plate-like members from slipping with respect to each other during adjustment of said inset.

9. Adjustable inset brackets for an inset, said inset being disposed in a recessed portion of a work surface, a corresponding one of said adjustable inset brackets being disposed at either longitudinal end of said inset, each of said adjustable inset brackets comprising:

(a) a first outer plate-like member having a generally L-shaped cross-section including a first vertically extending portion and a first horizontal flange portion facing outwardly, said first vertically extending portion having at least one vertical elongated slot formed therein, said first horizontal flange portion having a plurality of first spaced-apart through-holes formed therein, and said first horizontal flange portion of said first outer plate-like member being fixedly secured to an underside of said work surface by securing means passing through said plurality of spaced-apart through-holes;

(b) a second inner plate-like member disposed face-to-face so as to contact said first outer plate-like member and having a generally L-shaped cross-section including a second vertically extending portion and a second horizontal flange portion facing inwardly, said second vertically extending portion having at least one vertical elongated slot which is aligned with the elongated slot of the first outer plate-like member, said second horizontal flange portion having a plurality of second spaced-apart through-holes formed therein, and said second horizontal flange portion of said second inner plate-like member being fixedly secured to an underside of said inset by securing means passing through said plurality of second spaced-apart through-holes;

(c) an adjustment handle having a threaded shank portion, said threaded shank portion passing through the aligned vertical elongated slots of said first outer and second inner plate-like members, respectively; and (d) fastening means threadedly engaged with said threaded shank portion of said adjustment handle to thereby secure said first outer and second inner plate-like members together; whereby upon loosening of said adjustment handle of each of said adjustable inset brackets, said inset is adjustable to positions above, level with and below said work surface and tiltable with respect thereto;

wherein said first vertically extending portion of said first outer plate-like member and said second vertically extending portion of said second inner plate-like member are approximately triangular in shape, each of said first and second vertically extending portions including a single vertical elongated slot formed along a vertical center line thereof for receiving said threaded shank portion of said adjustment handle, such that each adjustable inset bracket has a corresponding said adjustment handle;

wherein an inner face of said first vertically extending portion of said first outer plate-like member and an outer face of said second vertically extending portion of said second inner plate-like member include friction means thereon in order to prevent said outer and inner plate-like members from slipping with respect to each other during adjustment of said inset; and further wherein said friction means comprises a starburst pattern stamped into said inner and outer faces.

10. Adjustable inset brackets for an inset, said inset being disposed in a recessed portion of a work surface, a corresponding one of said adjustable inset brackets being disposed at either longitudinal end of said inset, each of said adjustable inset brackets comprising:

(a) a first outer plate-like member having a generally L-shaped cross-section including a first vertically extending portion and a first horizontal flange portion facing outwardly, said first vertically extending portion having at least one vertical elongated slot formed therein, said first horizontal flange portion having a plurality of first spaced-apart through-holes formed therein, and said first horizontal flange portion of said first outer plate-like member being fixedly secured to an underside of said work surface by securing means passing through said plurality of first spaced-apart through-holes;

(b) a second inner plate-like member disposed face-to-face so as to contact said first outer plate-like member and having a generally L-shaped cross-section including a second vertically extending portion and a second horizontal flange portion facing inwardly, said second vertically extending portion having at least one vertical elongated slot which is aligned with the elongated slot of the first outer plate-like member, said second horizontal flange portion having a plurality of second spaced-apart through-holes formed therein, and said second horizontal flange portion of said second inner plate-like member being fixedly secured to an underside of said inset by securing means passing through said plurality of second spaced-apart through-holes;

(c) an adjustment handle having a threaded shank portion, said threaded shank portion passing through the aligned vertical elongated slots of said first outer and second inner plate-like members, respectively; and (d) fastening means threadedly engaged with said threaded shank portion of said adjustment handle to thereby secure said first outer and second inner plate-like members together; whereby upon loosening of said adjustment handle of each of said adjustable inset brackets, said inset is adjustable to positions above, level with and below said work surface and tiltable with respect thereto;

wherein said vertically extending portion of said first outer plate-like member and said second vertically extending portion of said second inner plate-like member are approximately triangular in shape, each of said first and second vertically extending portions including a single vertical elongated slot formed along a vertical center line thereof for receiving said threaded shank portion of said adjustment handle, such that each adjustable inset bracket has a corresponding said adjustment handle;

wherein an inner face of said first vertically extending portion of said first outer plate-like member and an outer face of said second vertically extending portion of said second inner plate-like member include friction means thereon in order to prevent said outer and inner plate-like members from slipping with respect to each other during adjustment of said inset; and further wherein said friction means comprises a checked pattern stamped into said inner and outer faces.

11. Adjustable inset brackets for an inset, said inset being disposed in a recessed portion of a work surface, a corresponding one of said adjustable inset brackets being disposed at either longitudinal end of said inset, each of said adjustable inset brackets comprising:

(a) a first outer plate-like member having a generally L-shaped cross-section including a first vertically extending portion and a first horizontal flange portion facing outwardly, said first vertically extending portion having at least one vertical elongated slot formed therein, said first horizontal flange portion having a plurality of first spaced-apart through-holes formed therein, and said first horizontal flange portion of said first outer plate-like member being fixedly secured to an underside of said work surface by securing means passing through said plurality of first spaced-apart through-holes;

(b) a second inner plate-like member disposed face-to-face so as to contact said first outer plate-like member and having a generally L-shaped cross-section including a second vertically extending portion and a second horizontal flange portion facing inwardly, said second vertically extending portion having at least one vertical elongated slot which is aligned with the elongated slot of the first outer plate-like member, said second horizontal flange portion having a plurality of second spaced-apart through-holes formed therein, and said second horizontal flange portion of said second inner plate-like member being fixedly secured to an underside of said inset by securing means passing through said plurality of second spaced-apart through-holes;

(c) an adjustment handle having a threaded shank portion, said threaded shank portion passing through the aligned vertical elongated slots of said first outer and second inner plate-like members, respectively; and (d) fastening means threadedly engaged with said threaded shank portion of said adjustment handle to thereby secure said first outer and second inner plate-like members together; whereby upon loosening of said adjustment handle of each of said adjustable inset brackets, said inset is adjustable to positions above, level with and below said work surface and tiltable with respect thereto;

wherein said first and second vertically extending portions each have a pair of spaced-apart vertical elongated slots, said pair of slots including a front elongated slot for receiving said threaded shank portion of a corresponding said adjustment handle and a rear elongated slot; and further comprising a rack and pinion articulation means disposed in said rear elongated slots.

12. Adjustable inset brackets for an inset, said inset being disposed in a recessed portion of a work surface, a corresponding one of said adjustable inset brackets being disposed at either longitudinal end of said inset, so as to provide a right side bracket and a left side bracket, each of said adjustable inset brackets comprising:

outer and inner plate-like members secured to an underside of said work surface and said inset, respectively, so that said outer and inner plate-like members are in face-to-face contact with each other, each of said outer and inner plate-like members having a front elongated slot and a rear elongated slot;

an adjustment handle having a shank portion passing through said front elongated slots, said shank portion receiving fastening means thereon; and a rack and pinion means disposed in said rear elongated slot for raising and lowering said inset.

13. The adjustable inset brackets according to claim 12, wherein said rack and pinion means includes a shaft extending between said right and left side brackets disposed at either longitudinal end of said inset and passing through said rear elongated slots of each of said right and left side brackets, said shaft having a right side outer pinion gear and right side inner pinion gear respectively engaging corresponding right side outer and inner toothed racks disposed along a side edge of said rear elongated slots of said outer and inner plate-like members, respectively, of said right side bracket, and having a left side outer pinion gear and left side inner pinion gear respectively engaging corresponding left side outer and inner toothed racks disposed along a side edge of said rear elongated sots of said outer and inner plate-like members, respectively, of said left side bracket.

14. The adjustable inset brackets according to claim 13, further comprising a pivotable locking rack positioned along a side edge of said rear elongated slot of said inner plate-like member of one of said right side and said left side brackets, said pivotable locking rack being disposed opposite a corresponding inner toothed rack of said rack and pinion means and adapted to engage with and disengage from a corresponding inner pinion gear so as to lock and unlock said rack and pinion means.

* * * * *